US007059104B2

(12) United States Patent
Taylor

(10) Patent No.: US 7,059,104 B2
(45) Date of Patent: Jun. 13, 2006

(54) SYSTEM FOR FILLING AND CLOSING FLUID CONTAINING CARTRIDGES

(75) Inventor: Douglas F. Taylor, Toledo, OH (US)

(73) Assignee: JAWS International, Ltd., Toledo, OH (US)

( * ) Notice: Subject to any disclaimer, the term of this patent is extended or adjusted under 35 U.S.C. 154(b) by 52 days.

(21) Appl. No.: 10/756,739

(22) Filed: Jan. 13, 2004

(65) Prior Publication Data

US 2005/0150191 A1 Jul. 14, 2005

(51) Int. Cl.
*B65B 7/26* (2006.01)
*B65B 7/28* (2006.01)

(52) U.S. Cl. ..... 53/471; 53/130.1; 53/137.1

(58) Field of Classification Search ..... 53/471, 53/503, 130.1, 137.1, 430; 198/470.1, 471.1, 198/476.1

See application file for complete search history.

(56) References Cited

U.S. PATENT DOCUMENTS

| | | | | |
|---|---|---|---|---|
| 959,577 | A | 5/1910 | McEwan | |
| 1,215,812 | A * | 2/1917 | Illian | 53/130.1 |
| 1,766,962 | A | 6/1930 | Strandt | |
| 2,150,913 | A | 3/1939 | Drew | |
| 2,412,637 | A | 12/1946 | Smith | |
| 2,588,981 | A * | 3/1952 | Hole | 137/119.01 |
| 3,070,932 | A | 1/1963 | Hofliger | |
| 3,273,309 | A | 9/1966 | Wolf et al. | |
| 3,461,646 | A | 8/1969 | Lane et al. | |
| 3,574,270 | A | 4/1971 | Rosendahl | |
| 3,775,934 | A | 12/1973 | Smith | |
| 4,151,698 | A | 5/1979 | Muller et al. | |
| 4,205,502 | A * | 6/1980 | Ahlers | 53/308 |
| 4,469,150 | A * | 9/1984 | Grimaldi | 141/95 |
| 4,691,496 | A * | 9/1987 | Anderson et al. | 53/53 |
| 4,693,052 | A | 9/1987 | Rebmann et al. | |
| 4,886,178 | A * | 12/1989 | Graf | 215/247 |
| 4,936,072 | A | 6/1990 | Creed et al. | |
| 5,125,208 | A * | 6/1992 | Tsukada et al. | 53/366 |
| 5,161,302 | A * | 11/1992 | Mueller | 29/773 |
| 5,301,488 | A | 4/1994 | Ruhl et al. | |
| 5,337,796 | A | 8/1994 | Ohmori et al. | |
| 5,351,462 | A * | 10/1994 | Anderson et al. | 53/410 |
| 5,526,853 | A * | 6/1996 | McPhee et al. | 141/329 |
| 5,584,161 | A * | 12/1996 | Zanini et al. | 53/317 |
| 5,626,000 | A | 5/1997 | Edwards et al. | |
| 5,884,457 | A * | 3/1999 | Ortiz et al. | 53/468 |
| 6,082,418 | A | 7/2000 | Naecker et al. | |
| 6,290,100 | B1 | 9/2001 | Yacko et al. | |
| 6,463,968 | B1 | 10/2002 | Hattori et al. | |
| 6,494,238 | B1 * | 12/2002 | Sindermann | 141/6 |
| 6,846,293 | B1 * | 1/2005 | Butler et al. | 600/573 |
| 6,857,250 | B1 * | 2/2005 | Taylor | 53/331 |
| 6,871,482 | B1 * | 3/2005 | Cirio | 53/490 |

(Continued)

FOREIGN PATENT DOCUMENTS

FR 2278029 A * 3/1976

*Primary Examiner*—Scott A. Smith
*Assistant Examiner*—Gloria R. Weeks
(74) *Attorney, Agent, or Firm*—Fraser Martin & Miller LLC; Donald R. Fraser

(57) ABSTRACT

A filling and closing system for reusable concentrate containing cartridges having integral closures slidable between open and closed positions. The system includes a sealing station having an axially moving reciprocating member for sliding the integral closure from an open to a closed position.

3 Claims, 7 Drawing Sheets

U.S. PATENT DOCUMENTS

2002/0017082 A1* 2/2002 Cornell et al. ..... 53/474
2002/0063215 A1* 5/2002 Yagita ..... 250/341.1
2003/0037514 A1* 2/2003 Hartness et al. ..... 53/471
2003/0150514 A1 8/2003 De Villele

* cited by examiner

SYSTEM FOR FILLING AND CLOSING FLUID CONTAINING CARTRIDGES

BACKGROUND OF THE INVENTION

1. Field of the Invention

The invention relates to a system for filling and closing fluid containing cartridges and, more particularly, to a system for filling reusable concentrate containing cartridges of the type used in a diluting and dispensing container for combining at least two separate components of a multi-component system, as illustrated and described in U.S. Pat. No. 6,290,100 in the names of R. Bruce Yacko and Edward L. Mueller.

2. Description of the Prior Art

The filling process generally includes providing a supply of containers along a conveyer, filling the containers at a filling position, and closing the containers at a closing and capping position. This process may produce by separate and distinct filling and capping machines or may include a single or mono-block machine which conveys, fills and caps. Depending upon the structure, the conveying system may be a linear conveyor or may be a combination of a linear conveyor with a circular conveyor or turret. In the turret system, the containers are positioned at the filling and capping stations along the turret.

The method of filling and transporting or conveying is generally the function of the type and size of the container as well as the fill product. For liquids in wide mouthed containers, spilling during transport is a problem which must be addressed. There are many various solutions in the prior art to address this problem and they generally include different acceleration, deceleration cycles as well as velocity as the containers move between the various stations. Some products are filled bottom to top; others are filled from the top down. Thus, the vertical position of the filling nozzle must be continually adjusted for the type of product to be filled. Similarly, the vertical positions of the filling nozzle as well as the vertical position of the capper must be adjusted for various heights of containers. Since the prior art used mechanical drives for the filling and capping unit using cams and other linkages, a considerable amount of time was needed to readjust the machine for different types of fill product and containers.

The conveying system also includes cams, mechanical linkages, to determine the position of the containers on the conveyor. In the turret conveying system, industry has used an indexer which indexes twelve positions about the 360° of rotation of the turret. Thus, if more container pockets are to be included on the turret, the fill and capping position had to be adjusted with respect to the turret, or the diameter of the turret had to be increased to accommodate the positioning of the additional pockets. Again, this required mechanical modification of the machine for pocket locations whether it be the number of pockets or the size of the pockets. Thus, if the shape or diameter of the container changed, the turret itself or the location of the capping and filling devices had to be adjusted mechanically. Other stations may be provided along the path including a plug insertion device as well as a cap-tightening device.

U.S. Pat. No. 5,301,488 discloses a filling and capping machine which can accommodate and adjust itself for various containers and fill product without substantial mechanical modification.

The machine includes a computer-controlled turret having a plurality of pockets for positioning a plurality of containers to at least a fill position and a capping position along the turret's path. The controller programmably positions the turret to these positions for variations of the locations of the pockets on the turret. This accommodates for variations in the size and number of the container pockets. The controller also programmably operates the turret at predetermined speeds for variations in the type of fill product and type of containers. The controller also controls the position of the filling unit for the type of fill product as well as controlling the positioning of the filling unit and the capping unit for variations in the type of container. The controller uses servomotors to position the turret, the filling unit and the capper. Preferably the vertical position of the filling unit and the capper are controlled by servomotors. The angular position of the capper to retrieve caps from a pickup position to a capping position is controlled by a fluid motor. Similarly, a plugging unit may be included and operated similarly to the capping unit, wherein the controller provides a servomotor for the vertical movement for the plugging unit and a fluid motor to rotate the plugging unit from its plug pickup position to its plugging position. A cap-tightening unit may also be provided along the path of the turret to tighten the caps initially started by the capping unit. The tightening unit is controlled vertically by a first motor and the twisting position by a second motor. The first motor is fluid and the second motor is a servomotor. A torque sensor is provided to control the twisting servomotor. The capping unit includes a second motor to twist the cap on during the vertical travel of the capping unit. A vacuum device is used for holding and releasing the cap and the plug. The servomotors are connected to the filling unit and the capping unit by ball and screw drives. The servomotor for the conveyor is connected through a gear reducer to extend the fineness of positioning and range of speeds of positioning of the turret.

It is an object of the present invention to produce a system for filling and closing fluid containing cartridges.

Another object of the invention is to produce a system for filling reusable cartridges with fluid concentrate, closing the filled cartridges, and discharging the filled cartridges.

Another object of the present invention is to produce a system for filling and closing fluid-containing cartridges wherein the filling and closing of the cartridges is automatically and simultaneously achieved.

The above objects may typically be achieved by a system for filling and closing fluent containing cartridges comprising a supply reservoir of cartridges having a hollow interior and a closure movable between an open and closed position; a filling station including means for conveying fluent material from a remote source and discharging the fluent material into the interior of the cartridge; a sealing station including means for causing the closure of the cartridge to move from an open position to a closed position; a discharge station including means for guiding the filled and sealed cartridges to a point of discharge from the system; and conveyor means for sequentially conveying cartridges from the supply reservoir to the filling station with the closure of the cartridge in an open position, thence conveying the cartridges filled with fluent material to the sealing station and causing the closure to be moved to a closed position sealing the fluent material therein, and finally conveying the sealed cartridges to the discharge station.

BRIEF DESCRIPTION OF THE DRAWINGS

The above objects and advantages of the invention will become readily apparent to those skilled in the art from reading the following detailed description of a preferred embodiment of the invention when considered in the light of the accompanying drawings, in which.

DETAILED DESCRIPTION OF THE PREFERRED EMBODIMENT OF THE INVENTION

Figure 1:
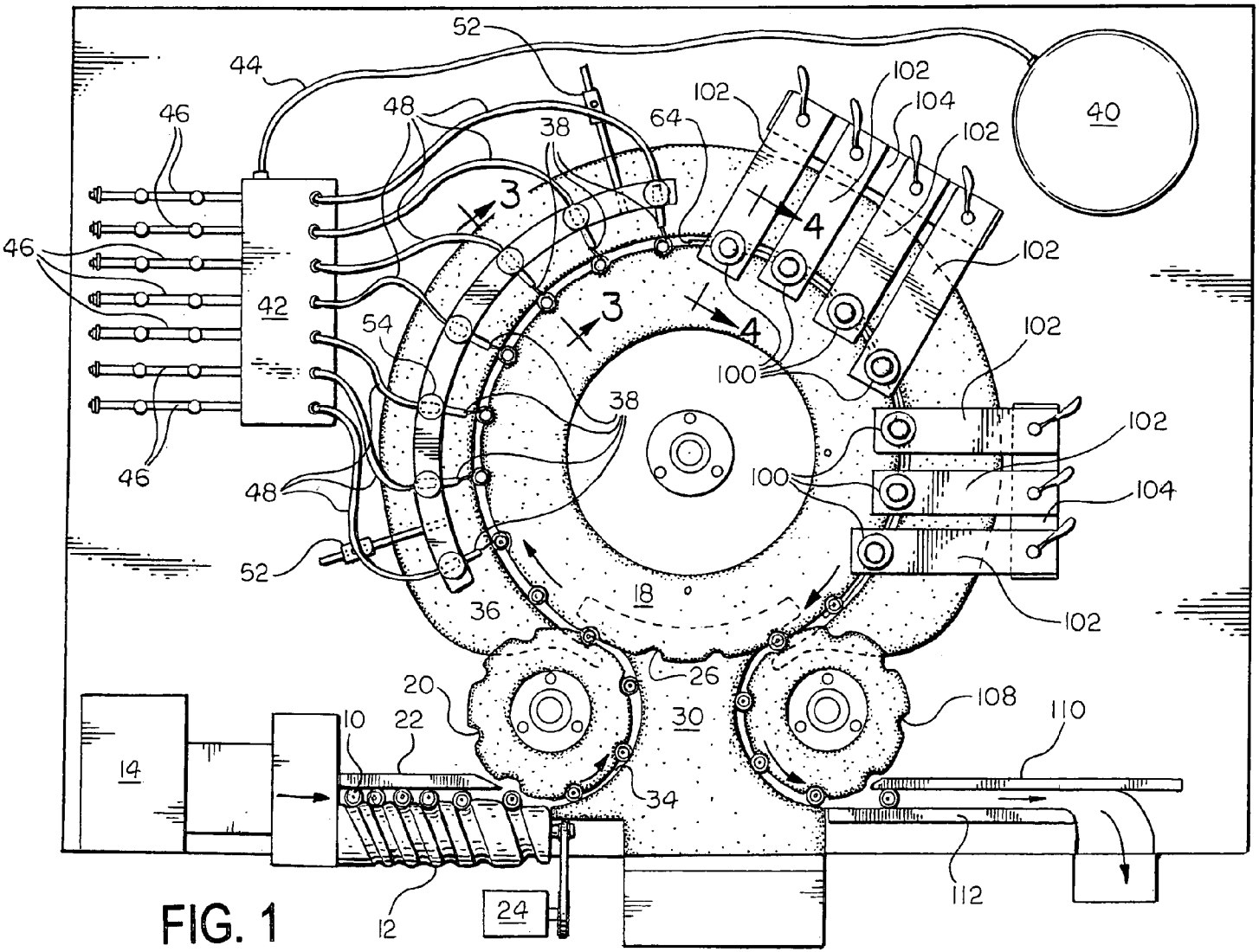
FIG. 1 is a top plan view of a system for filling and closing fluid containing cartridges incorporating the features of the present invention.
Figure 2:
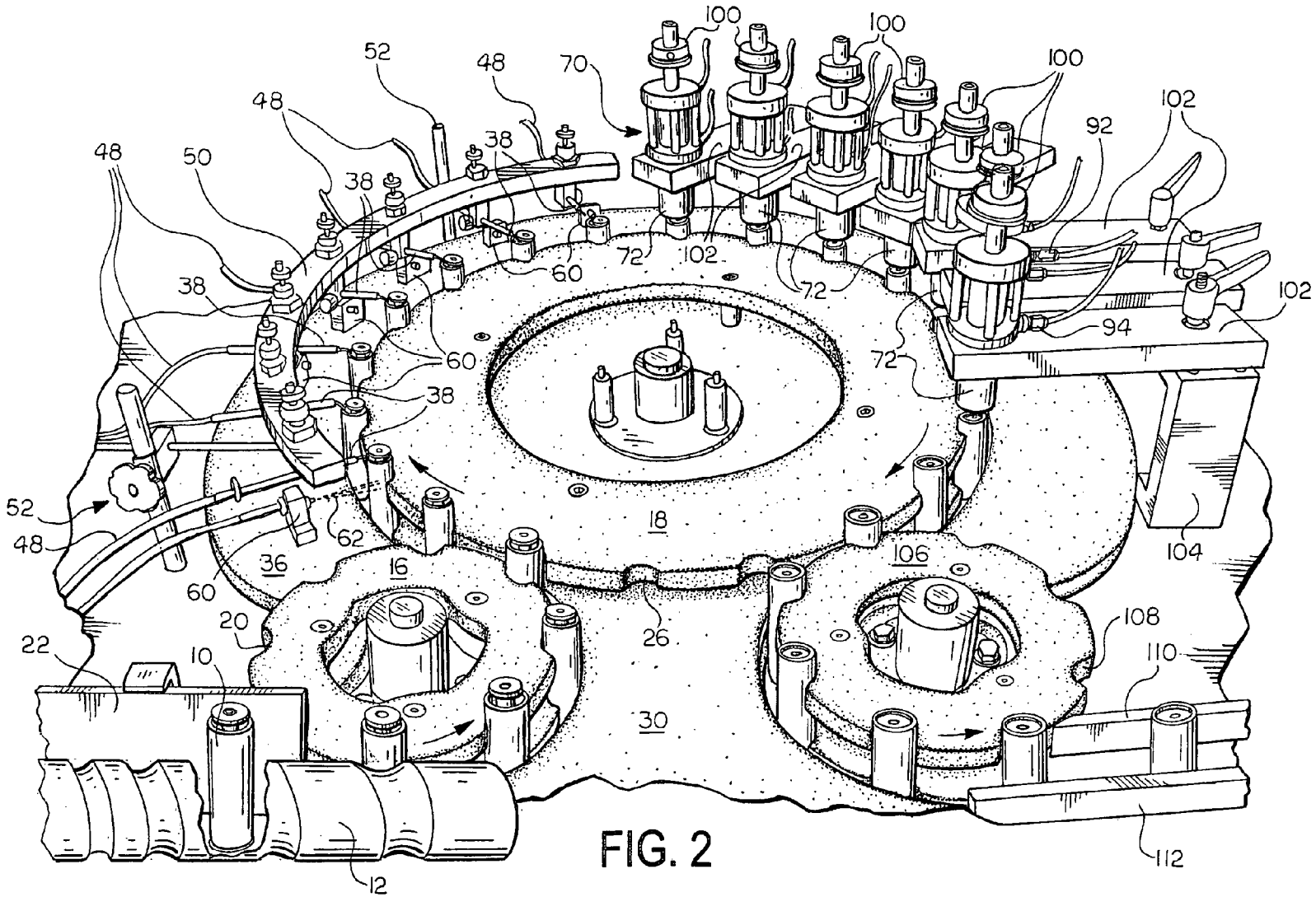
FIG. 2 is an enlarged perspective fragmentary view of the system illustrated in FIG. 1 with a portion partially cut away to more completely illustrate the structure of the cartridge being processed.

Referring to the drawings and particularly to FIGS. 1 and 2, there is illustrated a system for filling and closing a cartridge 10. The structure of the cartridge 10 is illustrated and described in U.S. Pat. No. 6,290,100 entitled CONCENTRATE CARTRIDGE FOR A DILUTING AND DISPENSING CONTAINER issued on Sep. 18, 2001 in the names of R. Bruce Yacko and Edward L. Mueller.

Figure 3:
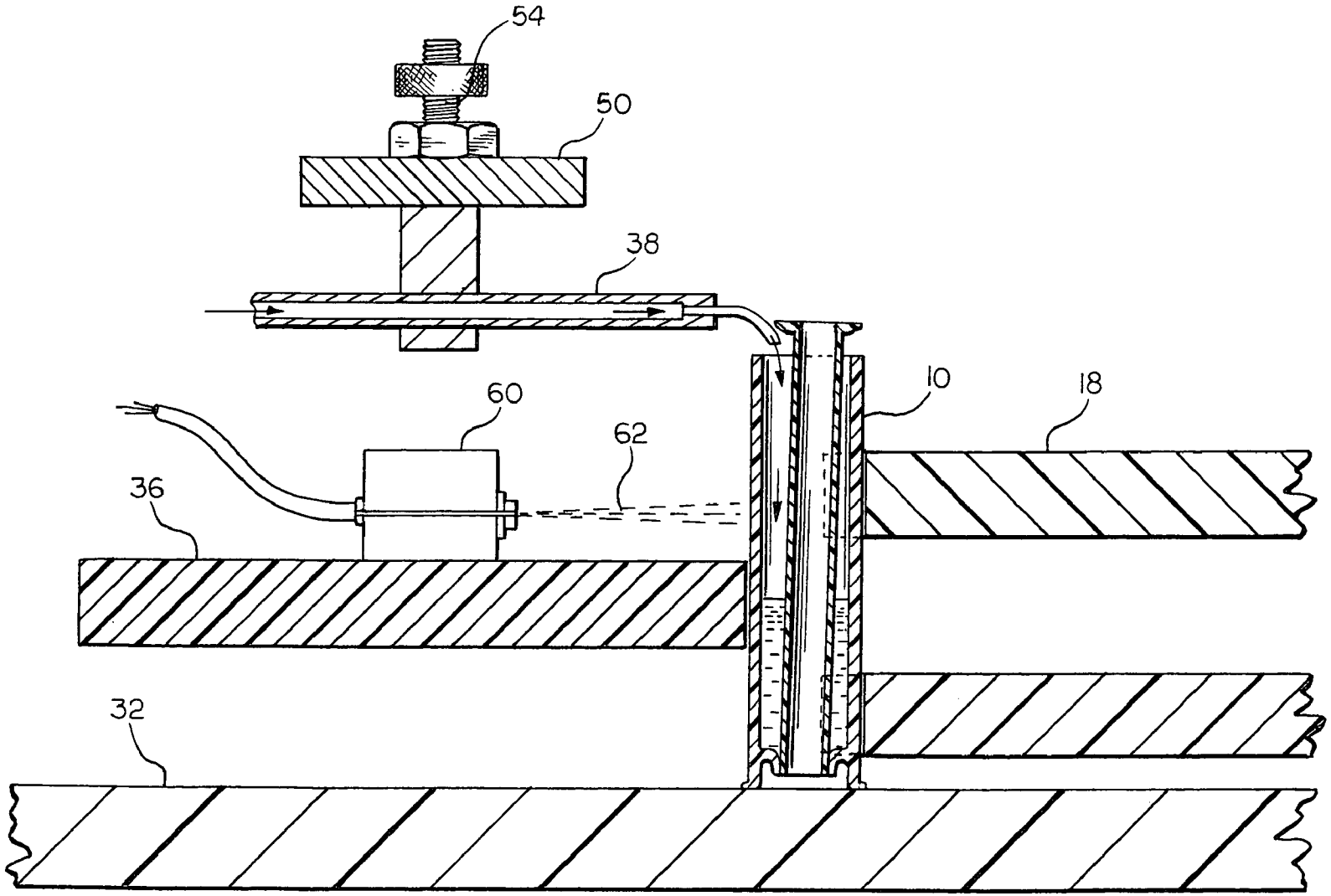
FIG. 3 is an enlarged sectional view taken along line 3—3 of FIG. 1.

The system comprises a supply station which includes an inlet screw-type conveyor 12 for conveying cartridges 10 from a supply 14 to an infeed turret or star member 16 and thence to a center turret or star member 18. The center turret 18, in the illustrated embodiment, includes two substantially identical spaced apart members as illustrated in FIG. 3, for example. The infeed turret 16 is provided with a plurality of spaced apart circumferentially disposed pockets 20 adapted to receive individual containers 10 which are typically fed from the supply 14 and guided to travel along a linear path between a guide rail 22 and the threaded outer wall of the screw conveyor 12. The threaded outer wall of the screw conveyor 12 is in the form of a helix wherein the spacing between the individual helixes of the conveyor 12 determines the spacing between the containers 10 as the containers 10 are presented to the spaced apart pockets 20 of the infeed turret 16. It will be appreciated that the conveyor 12 is driven, in the illustrated embodiment, by a drive motor 24, for example.

It should further be appreciated that the cartridges 10 leave the supply 14 in an open upright position, which is illustrated in FIG. 2, and are then sequentially transferred by means of the screw conveyor 12 to the individual pockets 20 of the infeed turret 16. By synchronized rotation of the infeed turret 16 and the center turret 18, the cartridges 10 are transferred from the pockets 20 of the infeed turret 16 to corresponding pockets 26 formed on the peripheral circumferential edge of the center turret 18. In order to assure that the cartridges 10 are maintained in an upright position as they are conveyed by the turrets 16 and 18, a guide plate 30 is provided in spaced vertical position above a universal base 32. The bottom of the cartridges 10 contact the upper surface of the base 32 as the cartridges 10 are conveyed through the system.

The plate 30 is formed with a semicircular side edge 34 which is spaced from a portion of the circumference of the infeed turret 16. The outer edge of the turret 16 with the pockets 20 is adapted to rotate in synchronism with the rotation of the outer edge of the inner turret 18 with the pockets 26 such that the respective pockets 20 and 26 index with one another to assure constant conveyance of the cartridges 10 toward a filling station.

The filling station includes an annular guide plate 36 which has an inner edge in facing spaced relation from the outer peripheral edge of the center turret 18. The annular guide plate 36 cooperates with center turret 18 to maintain the cartridges 10 in an upright position as they are caused to be conveyed in a clockwise direction by rotation of the inner turret 18.

The filling station further includes a plurality of spaced apart individual filling nozzles 38 (seven in the illustrated embodiment). The filling nozzles 38 are spaced along the arcuate path defined by the inner edge of the plate 36 and are spaced apart the same as the spacing of the pockets 26 of the center turret 18. Each of the nozzles 38 communicates with a source 40 of fluid concentrate through a manifold 42 and a supply line 44. The manifold 42 contains individually actuated valve assemblies 46 which communicate through discharge lines 48 with respective ones of the discharge nozzles 38. The valve assemblies 46 are effective to meter the flow of concentrate to the discharge nozzles 38 from the supply reservoir 40.

An annular mounting rail 50 for supporting the discharge nozzles 38 is mounted to the base 32 by means of at least two spaced mounting post assemblies 52. Each of the individual nozzles 38 may be selectively mounted to the rail 50 by adjustable threaded fasteners 54. The threaded fasteners 54 facilitate the final adjustment of the discharge nozzles 38 to direct the flow of concentrate into the cartridges 10 being filled, as will be explained in greater detail hereinafter.

A photoelectric cell 60 is mounted on the upper surface of the guide plate 36. The photocell 60 is adapted to emit a light beam 62 directed toward a container 10 as is clearly illustrated in FIGS. 2 and 3. The photocell 60 is capable of emitting a light beam 62 and reading the light beam reflected from the impinging light beam 62 to determine whether a container 10 is present. For the container 10 to be filled, the photocell 60 must sense the presence of a container. This portion of the operation of the system will be explained in greater detail in the following description.

The next station of the system is referred to as the closing or sealing station. A trench or groove 64 is formed in the universal base 32 below the space between the outwardly facing peripheral wall of the center turret 18 and the facing inner edge of the plate 36. The trench 64 is formed on substantially the same radius as the outer edge of the center turret 18 and the inner edge of the plate 36. The width and depth of the trench 64 are sufficient to receive the hollow inner tube portion of the cartridge 10 and, at the same time, the upper outer edges of the trench 64 support the lower end of the tubular body of the container 10. In certain instances, the ends of the cartridges 10 being supported by the upper outer edges of the trench 64 are flanged outwardly and thereby facilitate the support and stability of the cartridges 10 as they are conveyed through the system.

It will be understood that the entrance end of the trench 64 most adjacent to the exit end of the filling station ramps gradually downwardly so as to permit closing of the filled cartridge 10, as will be illustrated and explained.

Further, the sealing station includes a plurality of spaced apart sealing modules 70. Since the sealing modules 70 are substantially identical with one another, for simplicity sake, only a single one will be explained in detail. Accordingly, the sealing modules 70 are spaced along the arcuate path defined by the trench 64 and are spaced apart the same as the spacing of the pockets 26 of the center turret 18.

Each of the individual sealing modules 70 includes a hollow collar 72 having an open end defined by inwardly tapered end wall 74. The opposite end of the collar 72 is provided with an annular aperture for slidingly receiving a reduced neck 76 of a plunger 78. The plunger 78, at the opposite end from the neck 76, is provided with a convex outwardly curving surface 80. The neck 76 of the plunger 78 is internally threaded to receive the external threaded shank of a connector 82. The opposite end of a connector 82 is threadably received within the internally threaded end of an armature 84 of a pressure fluid actuated motor 86. The motor 86 includes a cylinder 88 housing a piston 90 connected to the armature 84 and pressure fluid couplings 92 and 94 which coupled to valves, not shown, for controlling the reciprocation of the piston 90 and the armature 84. Control valving is employed for regulating the flow of pressure fluid to the motor 86 from a remote source. A jam nut 96 may be employed to secure the threaded connector 82 to the armature 84.

A threadably adjustable jam nut 100 is effective to limit the reciprocal stroke of the armature 84.

Each of the sealing modules 70 is mounted on one end of a horizontally disposed beam 102, while the opposite end of the beam 102 is supported on a suitably disposed base member 104. In the illustrated embodiment of the invention the beams 102 are mounted to the base 104 by a suitably designed threaded fastener illustrated diagrammatically in FIGS. 1 and 2. These fasteners can provide for vertical and pivotal adjustment of the associated sealing modules 70 in respect of the cartridges 10 being acted upon.

The trench 64 terminates at the exit of the sealing station by means of an upwardly inclined ramp causing the filled and sealed cartridges to be supported and slide upon the supply surface of the base 32. At this point the cartridges 10 are moved by the center turret 18 in combination with the inner arcuate edge of the outer guide plate 36.

A discharge station is disposed immediately adjacent the sealing station and is designed to receive and convey the filled and sealed cartridges 10, as the cartridges 10 exit the sealing station.

The discharge station includes a discharge turret or star member 106 provided with an array of annularly disposed spaced apart pockets 108 which are caused to be synchronized with the pockets 26 of the center turret 18 to effectively continue the conveyance of the cartridges 10 as they exit the sealing station. It will be appreciated that the discharge turret 106 will be driven to rotate in a counterclockwise direction. Thus, the cartridges 10 are sequentially received by the pockets 108 and, in cooperation with the pockets 26 of the clockwise moving center turret 18, will convey the cartridges 10 in cooperation with the facing edge of the plate 30 through an annular path until the cartridges 10 are caused to sequentially enter the space between the spaced apart guide rails 110 and 112.

In summary, the operation of the described and illustrated embodiment of the system for filling cartridges with fluent material and closing the filled cartridges is achieved in the following manner. Initially, the cartridges 10 are loaded into the supply 14 with the integral closure members thereof in an open position, as clearly illustrated in FIG. 2. Suitable motor drives; not shown, are caused to drive the turrets 16, 18, and 106 in a synchronized manner such that the open cartridges 10 are caused to be conveyed to a position such that the discharge end of the discharge nozzles 38 is received within respective ones of the cartridges 10.

Next, the valve assemblies 46 are actuated by any suitable means such as, for example, pneumatic, hydraulic, electric, or manual for example to permit the flow of fluent material from the source 40 to flow to the manifold 42 through the supply line 44. From the manifold 42 the fluent material flows through the discharge lines 48 and into the cartridges 10 through the nozzles 38. When the desired level of fluent material is reached within the cartridges 10, the level is sensed by the photocell 60 which produces a signal capable of closing the valves 46 and thereby prevent any further flow of fluent material into the cartridges 10.

The system is then caused to drive the turrets 16, 18, and 108 such that the filled cartridges 10 are indexed to the sealing station wherein each filled container 10 is moved into alignment with respective ones of the sealing modules 70 of the sealing station. Simultaneously, empty open cartridges 10 are indexed to positions to be filled by respective discharge nozzles 38.

The sealing modules 70 are typically operated by the admission of pressure fluid (pneumatic or hydraulic) to the fluid motor 86 into the cylinder 88 through the inlet coupling 92 to downward movement of the piston 90 and the armature 84. During the movement, the coupling 94 is caused to be opened to prevent any pressure acting against the downward movement of the piston 90. On the upward stroke of movement of the piston 90, the function of the inlet/outlet 92, 94 reverses.

Figure 4:
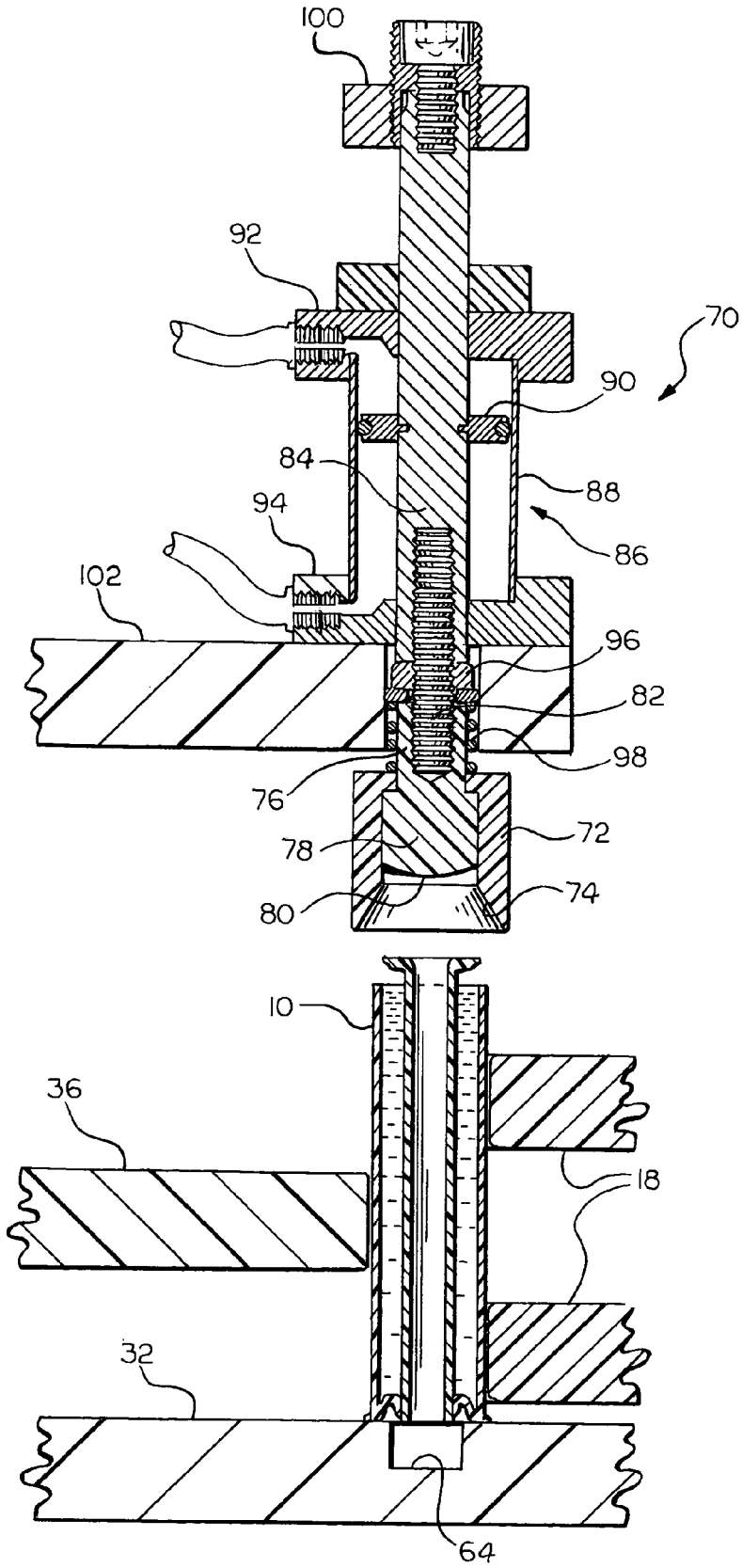
FIGS. 4, 5, 6,and 7 are enlarged sectional views taken along line 4—4 of FIG. 1 illustrating the sequence of the operation of the closing operation of the cartridges processed by the system of the invention.
Figure 5:
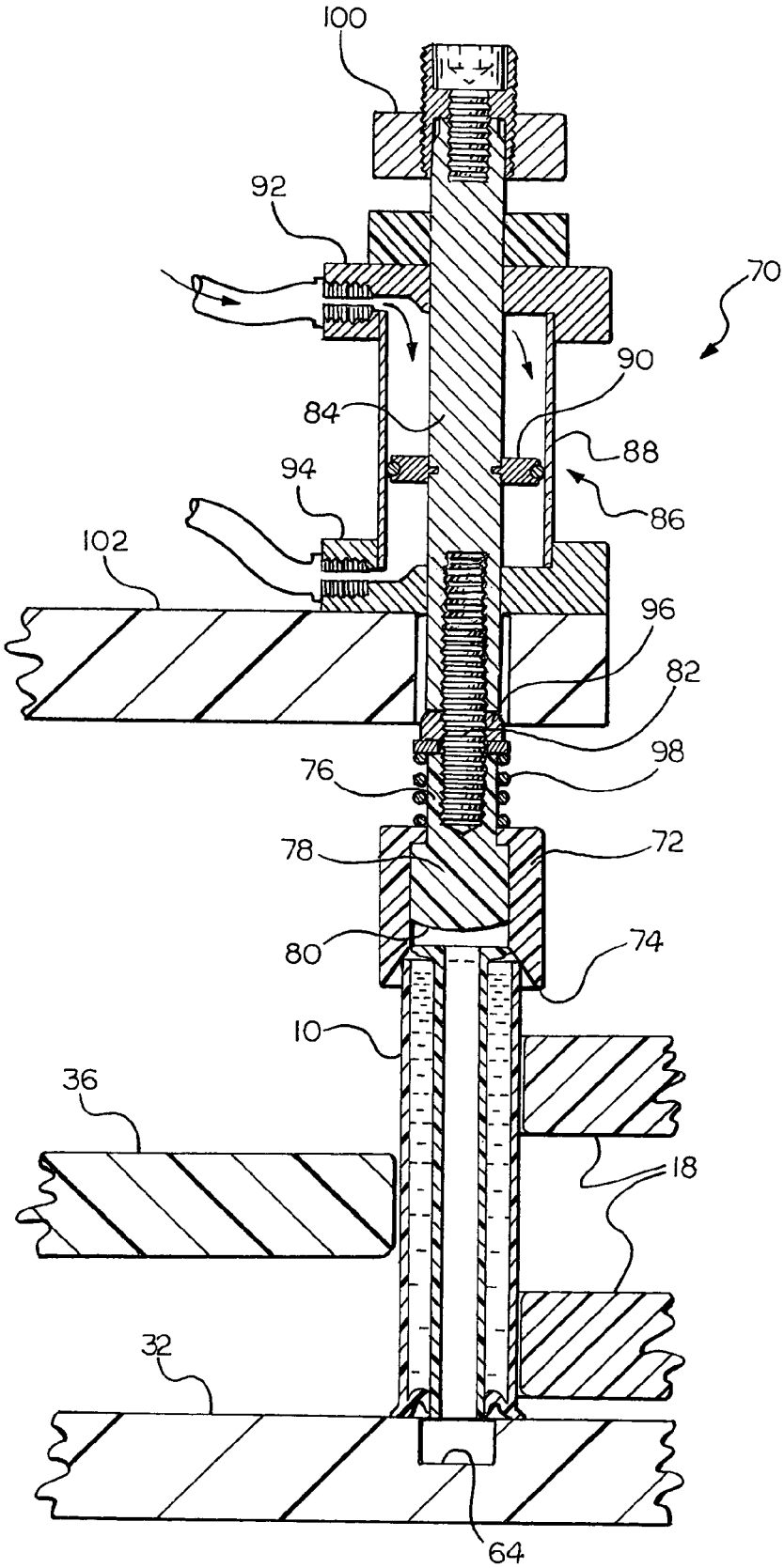
Figure 6:
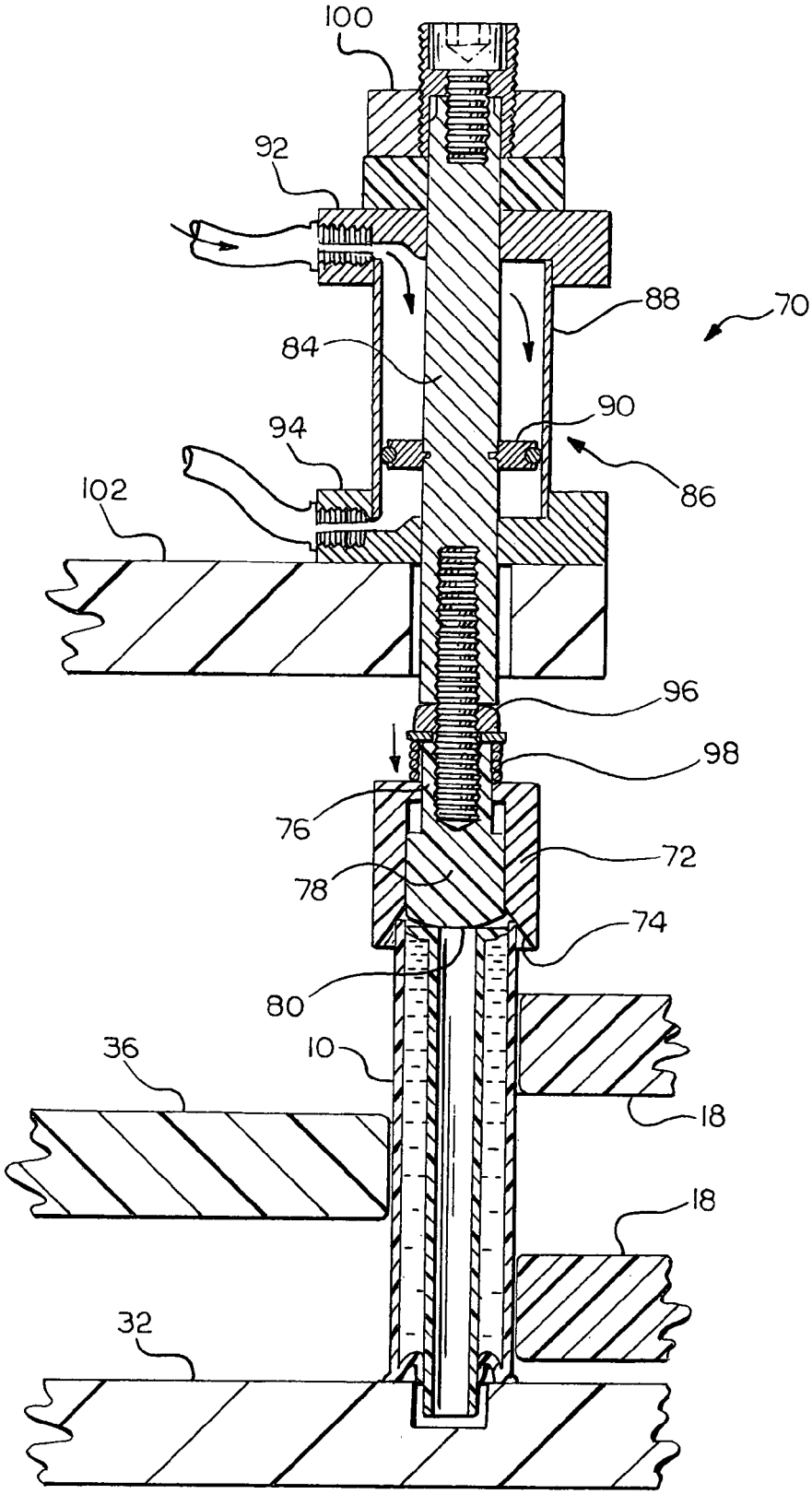

The downward movement of the armature 84, as illustrated in FIG. 4, the end wall 74 of the collar 72 approaches the closure member of the cartridge 10. FIG. 5 illustrates the continuing downward movement of the collar 72 as contact between the collar 72 and the upper portion of the cartridge 10. Initially, the tapered end wall 74 of the collar 72, contacts and secures the upper end of the cylindrical outer wall of the cartridge 10. Then the plunger 78 is forced downwardly, as illustrated in FIG. 6 to cause the lower curved surface 80 thereof to contact the upper end of the slidable centrally disposed closure member of the cartridge 10 to be urged downwardly into a closed and sealed position against the upper end of the cylindrical outer body of the cartridge 10 while the lowermost end of the central closure of the container 10 is caused to enter the trench 64. The sealing of the fluent material within the cartridge 10 is now completed.

Figure 7:
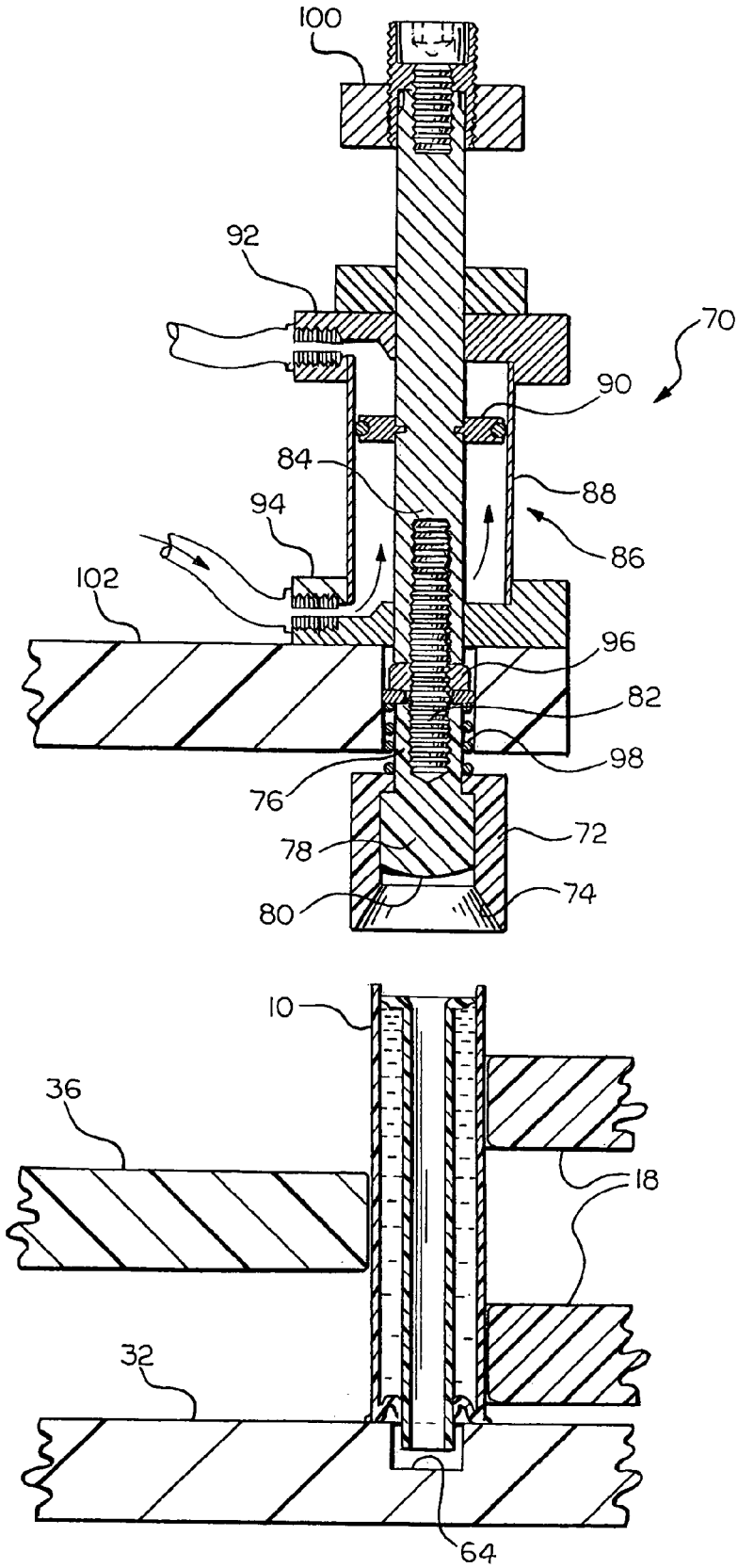

As illustrated in FIG. 7, pressure fluid is admitted to the cylinder 88 of the motor 86 through the new inlet 94 to force the piston 90 upwardly to removed the collar 72 from the upper end of the cartridge 10, to allow the next step in the operation to commence.

The final step in the operation of the system is to index the turrets 16, 18, and 106 to the positions illustrated in FIGS. 1 and 2 wherein all the stations of the filling station and the sealing station are occupied. Accordingly, during the next operating sequence of the system, seven empty cartridges 10 are filled, seven filled cartridges 10 are sealed, and seven filled and sealed cartridges 10 are discharged from the system.

It will be understood that while the illustrated embodiment of the invention shows seven cartridges 10 being filled, sealed, and discharged simultaneously, the system may be readily designed to handle different members of the containers without departing from the spirit of the invention.

Also, it will be evident that the system is useful for processing a number of different fluent materials such as liquid soaps, for example.

The particular drive mechanism employed to drive the turrets 16, 18 and 106 may electrically actuate the servomotors as well as other drive means capable of synchronizing the rotation of the turrets, as well as the conveyor 12.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A system for filling and closing fluent material containing cartridges comprising:

a supply station for cartridges having a hollow interior and an integral closure movable from an open to a closed position;

a filling station including means for conveying fluent material from a remote source and discharging the fluent material into the interior of the cartridge;

a sealing station including a collar for contacting and securing an end of the cartridge and an associated plunger movable relative to the collar for contacting the closure of the cartridge to axially move the closure from an open position to a closed position;

a discharge station including means for guiding the filled and sealed cartridges to a point of discharge from the system; and conveyor means for sequentially conveying cartridges from said supply station to said filling station with the closure of the cartridge in an open position, thence conveying the cartridges filled with fluent material to said sealing station and causing the closure to be moved to a closed position sealing the fluent material therein, and finally conveying the sealed cartridges to said discharge station, wherein said conveyor means includes a base having a trench for receiving a portion of the closure in a closed position.

2. A method of filling and sealing fluent material containing cartridges having a hollow interior and equipped with an integral closure slidably movable axially between an open and closed position including the steps of:

presenting at least one of the cartridges to be filled to a fluent material discharge with the integral closure in an open position;

filling the hollow interior of the cartridge with fluent material;

conveying the filled cartridges to a sealing station;

providing a plunger at the sealing station;

applying a force with the plunger against an end of the integral closure of the cartridge to cause the closure to slide axially from an open to a closed sealing position;

providing a space below the cartridge to receive the opposite end of the integral closure of the cartridge; and conveying the filled and sealed cartridge to a discharge station.

3. A system for filling and closing fluent material containing cartridges having integral closures slidably movable between and open and closed position comprising:

a supply station for cartridges having a hollow interior and an integral closure slidably movable in an axial direction between an open and closed position;

a filling station including means for conveying fluent material from a remote source and discharging the fluent material into the interior of the cartridge;

a sealing station including axially moving means for causing the closure of the cartridge to slide axially from an open position to a closed position;

a discharge station including means for guiding the filled and sealed cartridges to a point of discharge from the system; and conveyor means for sequentially conveying cartridges from said supply station to said filling station with the closure of the cartridge in an open position, thence conveying the cartridges filled with fluent material to said sealing station and causing the closure to be moved to a closed position sealing the fluent material therein, and finally conveying the sealed cartridges to said discharge station, wherein said conveyor means includes a base having a trench for receiving a portion of the closure in a closed position.

* * * * *